US009291967B2

(12) United States Patent
Iwaya et al.

(10) Patent No.: US 9,291,967 B2
(45) Date of Patent: Mar. 22, 2016

(54) FIXING DEVICE AND IMAGE FORMING APPARATUS INCORPORATING SAME

(71) Applicants: Naoki Iwaya, Tokyo (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takeshi Uchitani, Kanagawa (JP); Hiromasa Takagi, Tokyo (JP); Takuya Seshita, Kanagawa (JP); Takahiro Imada, Kanagawa (JP); Takamasa Hase, Shizuoka (JP); Hajime Gotoh, Kanagawa (JP); Arinobu Yoshiura, Kanagawa (JP); Teppei Kawata, Kanagawa (JP); Toshihiko Shimokawa, Kanagawa (JP); Shuutaroh Yuasa, Kanagawa (JP); Kazuya Saito, Kanagawa (JP); Kensuke Yamaji, Kanagawa (JP); Akira Suzuki, Tokyo (JP)

(72) Inventors: Naoki Iwaya, Tokyo (JP); Masahiko Satoh, Tokyo (JP); Masaaki Yoshikawa, Tokyo (JP); Kenji Ishii, Kanagawa (JP); Hiroshi Yoshinaga, Chiba (JP); Tadashi Ogawa, Tokyo (JP); Takeshi Uchitani, Kanagawa (JP); Hiromasa Takagi, Tokyo (JP); Takuya Seshita, Kanagawa (JP); Takahiro Imada, Kanagawa (JP); Takamasa Hase, Shizuoka (JP); Hajime Gotoh, Kanagawa (JP); Arinobu Yoshiura, Kanagawa (JP); Teppei Kawata, Kanagawa (JP); Toshihiko Shimokawa, Kanagawa (JP); Shuutaroh Yuasa, Kanagawa (JP); Kazuya Saito, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/536,173

(22) Filed: Nov. 7, 2014

(65) Prior Publication Data

US 2015/0063884 A1 Mar. 5, 2015

Related U.S. Application Data

(63) Continuation of application No. 13/717,046, filed on Dec. 17, 2012, now Pat. No. 8,953,994.

(30) Foreign Application Priority Data

Jan. 13, 2012 (JP) ..... 2012-005167

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2007; G03G 15/201; G03G 15/2017; G03G 15/2064; G03G 15/2078; G03G 15/2003; G03G 15/20
See application file for complete search history.

(56) References Cited

U.S. PATENT DOCUMENTS

| | | | |
|---|---|---|---|
| 5,300,996 | A | 4/1994 | Yokoyama et al. |
| 5,832,354 | A | 11/1998 | Kouno et al. |
| RE36,124 | E | 3/1999 | Yokoyama et al. |
| 5,915,147 | A | 6/1999 | Kouno et al. |
| 6,636,709 | B2 | 10/2003 | Furukawa et al. |
| 8,032,069 | B2 | 10/2011 | Shin et al. |
| 8,559,861 | B2 | 10/2013 | Lee et al. |
| 2002/0067936 | A1 | 6/2002 | Yasui et al. |
| 2003/0000933 | A1 | 1/2003 | Yoshinaga et al. |
| 2003/0016963 | A1 | 1/2003 | Yoshinaga et al. |
| 2003/0206758 | A1 | 11/2003 | Yasui et al. |
| 2004/0013453 | A1 | 1/2004 | Shinshi et al. |
| 2004/0247334 | A1 | 12/2004 | Kishi et al. |
| 2004/0258426 | A1 | 12/2004 | Kishi et al. |
| 2005/0025539 | A1 | 2/2005 | Yoshinaga |
| 2005/0074251 | A1 | 4/2005 | Katoh et al. |
| 2005/0095043 | A1 | 5/2005 | Yoshinaga et al. |

2005/0129432 A1 6/2005 Sato et al.
2005/0163543 A1 7/2005 Satoh et al.
2006/0051120 A1 3/2006 Kishi et al.
2006/0116230 A1 6/2006 Satoh et al.
2006/0165429 A1 7/2006 Satoh et al.
2006/0165448 A1 7/2006 Yoshinaga
2006/0177232 A1 8/2006 Ehara et al.
2006/0177251 A1 8/2006 Uehara et al.
2006/0182460 A1 8/2006 Kishi et al.
2006/0285893 A1 12/2006 Ishii
2007/0014600 A1 1/2007 Ishii et al.
2007/0014603 A1 1/2007 Satoh et al.
2007/0059011 A1 3/2007 Seo et al.
2007/0059071 A1 3/2007 Shinshi et al.
2007/0110464 A1 5/2007 Nakayama et al.
2007/0212089 A1 9/2007 Seo et al.
2007/0280754 A1 12/2007 Ogawa et al.
2007/0292175 A1 12/2007 Shinshi
2008/0044196 A1 2/2008 Seo et al.
2008/0063443 A1 3/2008 Yoshinaga et al.
2008/0124148 A1* 5/2008 Kim et al. ..... 399/331
2008/0253789 A1 10/2008 Yoshinaga et al.
2008/0317532 A1 12/2008 Ehara et al.
2009/0067902 A1 3/2009 Yoshinaga et al.
2009/0092423 A1 4/2009 Shin et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2010/0074667 A1 3/2010 Ehara et al.
2010/0092220 A1 4/2010 Hasegawa et al.
2010/0092221 A1 4/2010 Shinshi et al.
2010/0158587 A1 6/2010 Shin
2010/0202809 A1 8/2010 Shinshi et al.
2010/0290822 A1 11/2010 Hasegawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0076071 A1 3/2011 Yamaguchi et al.
2011/0085832 A1 4/2011 Hasegawa et al.
2011/0091253 A1 4/2011 Seo et al.
2011/0091254 A1 4/2011 Shin et al.
2011/0116848 A1 5/2011 Yamaguchi et al.
2011/0129268 A1 6/2011 Ishii et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229180 A1 9/2011 Saito
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

JP 2002-214953 7/2002
JP 2004-258484 9/2004
JP 2005-258484 A 9/2005
JP 2006-234864 9/2006
JP 2007-233011 9/2007
JP 2007-334205 12/2007
JP 2008-145903 A 6/2008
JP 2009-093141 A 4/2009
JP 2009-258203 11/2009
JP 2010-020248 1/2010
JP 2010-026058 2/2010
JP 2010-078839 4/2010
JP 2011-022430 2/2011

OTHER PUBLICATIONS

Japanese Office Action issued Dec. 1, 2014, in Japan Patent Application No. 2012-005167.

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A fixing device that fixes an image on a recording medium includes a rotatable endless belt, deployed in a loop supported by rollers, a nip forming member provided inside the loop formed by the belt, a support member that supports the nip forming member, a counter rotation body disposed outside the loop formed by the belt and configured to form a nip with the belt by being in contact with the nip forming member through the belt, and a heat source configured to heat the belt directly by a radiant heat except at the nip. The support member includes a base portion that contacts the nip forming member and two arms extending from the base portion in a direction away from the nip forming member to partially surround a part of heat generating portion of the heat source.

9 Claims, 7 Drawing Sheets

FIXING DEVICE AND IMAGE FORMING APPARATUS INCORPORATING SAME

CROSS-REFERENCE TO RELATED APPLICATIONS

This application is a continuation of U.S. application Ser. No. 13/717,046, filed Dec. 17, 2012, and is based upon and claims the benefit of priority from prior Japanese Patent Application No. 2012-005167, filed on Jan. 13, 2012, the entire contents of both are incorporated herein by reference.

BACKGROUND OF THE INVENTION

1. Field of the Invention

This invention relates to a fixing device which fixes an image on a recording medium and to an image forming apparatus incorporating the fixing device.

2. Description of the Related Art

As a fixing device used for a variety of image forming apparatuses such as copiers, printers, facsimiles, multifunction apparatuses that print, fax, copy, and so on, a device which includes a thin fixing belt consisting of a metal substrate and an elastic rubber layer is known. Use of such a thin fixing belt which has a low heat capacity makes it possible to drastically reduce the amount of energy required to heat the fixing belt to required temperatures. Accordingly, it is possible to shorten a warm-up time (e.g., at power-up, a time required to go from a room temperature to a predetermined temperature (reload temperature) for printing), and a time to first print (i.e., a time to completion of the paper output after performing printing operation including preparation for printing after receiving a print request). Conventionally, as shown in FIG. 1, such a fixing device includes an endless belt (fixing belt) 100 formed into a loop, a pipe-shaped metal heat conduction member 200 disposed within the loop formed by the endless belt 100, a heat source 300 disposed inside the metal heat conductor 200, and a pressure roller 400 to form a nip portion N by contacting the metal heat conductor 200 via endless belt 100 (See JP-2007-334205-A).

In this case, the endless belt 100 is rotated by the rotation of the pressure roller 400, and at this time, the metal heat conductor 200 guides the movement of the endless belt 100. Further, since the endless belt 100 is heated by the heat source 300 disposed inside the metal heat conductor 200 via the metal heat conductor 200, it becomes possible to warm the entire endless belt 100. Accordingly, it is possible to shorten the time to first print from the heating wait state and overcome the shortage of heat during high speed operation.

In order to achieve further improvement of the energy efficiency and time to first print, a fixing device which heats the endless belt directly (without heating through the metal heat conductor) has been proposed (See JP-2007-233011-A).

In the example shown in FIG. 2, the pipe-shaped metal heat conductor is not provided inside the endless belt 100. Instead, a planar nip forming member 500 is provided at a position facing a pressure roller 400. In this case, since it is possible to heat the endless belt 100 directly by the heat source 300 at a portion other than the portion where the nip forming member 500 is disposed, heat transfer efficiency is significantly improved and power consumption can be reduced. Accordingly, it is possible to further shorten time to first print. Further, since the metal heat conductor is not provided, cost reduction can be also expected.

A variety of fixing devices which heats the endless belt directly is known.

FIG. 3 is another example of a fixing device which heats the endless belt directly. The fixing device shown in FIG. 3 includes a nip forming member 500 and a shielding member 700 that shields heat from a heat source 300 to a support member 600 that supports the nip forming member 500 (See JP-2010-20248-A). In this device, in the cross-sectional view perpendicular to the axial direction of the endless belt 100, the shielding member 700 has a convex shape toward the heat source 300. The shielding member 700 is formed in this way so as to increase the area of the endless belt 100 to be heated directly.

FIG. 4 is another example of a fixing device. The fixing device shown in FIG. 4 includes a reflective member (reflector) 800 which reflects the radiation light emitted from the heat source 300 to the endless belt 100. The reflective member 800 is formed of a support portion 800*b* disposed in substantially vertical direction, and a pressure receiving portion 800*a* projecting in substantially horizontal direction from the lower end of the support portion 800*b* (side end portion of the pressure roller 400), and a radiation adjusting section 800*c* projecting in substantially horizontal direction from the upper end portion of the support portion 800*b* (end portion opposite to the pressure roller 400) (See JP-2010-78839-A). In the radiation adjusting section 800*c*, a plurality of cutouts are formed in the width direction of the endless belt 100. Therefore, the occurrence of unevenness of the temperature of the belt surface is prevented by varying the radiation time of the radiation light for the endless belt 100 in the belt width direction.

As described above, by heating the endless belt directly, it becomes possible to achieve high energy efficiency and shorten the time to first print. However, there are drawbacks. One of them is the thermal deformation of the endless belt called kinking. Kinking is a phenomenon in which localized thermal expansion occurs when a part of the belt in the circumferential direction is heated rapidly so that the endless belt is deformed due to the expansion difference between the part being heated and the part that is not heated directly. Particularly in the configuration using an extremely thin endless belt to improve energy efficiency and time to first print which is popular in the recent years, the possibility of kinking occurring is increased because the endless belt is likely to be heated.

As a way to avoid kinking, a method in which a broad area of the endless belt is heated may be used. However, when the area of the endless belt to be heated is too broad, components other than the fixing belt which do not need to be heated may be heated up, resulting in a new problem, for example, heating efficiency deteriorates.

SUMMARY OF THE INVENTION

The present invention has been made in view of the above points, and provides an improved fixing device that includes a rotatable endless belt, deployed in a loop supported by rollers, a nip forming member provided inside the loop formed by the belt, a support member that supports the nip forming member, a counter rotation body disposed outside the loop formed by the belt and configured to form a nip with the belt by being in contact with the nip forming member through the belt, and a heat source configured to heat the belt directly by a radiant heat except at the nip. The support member includes a base portion that contacts the nip forming member and two arms extending from the base portion in a direction away from the nip forming member to partially surround a part of heat generating portion of the heat source.

BRIEF DESCRIPTION OF THE SEVERAL VIEWS OF THE DRAWINGS

A more complete appreciation of the invention and many of the advantages thereof may be obtained as the same become better understood by reference to the following detailed description when considered in connection with the accompanying drawings, wherein.

DETAILED DESCRIPTION OF THE INVENTION

Figure 1:
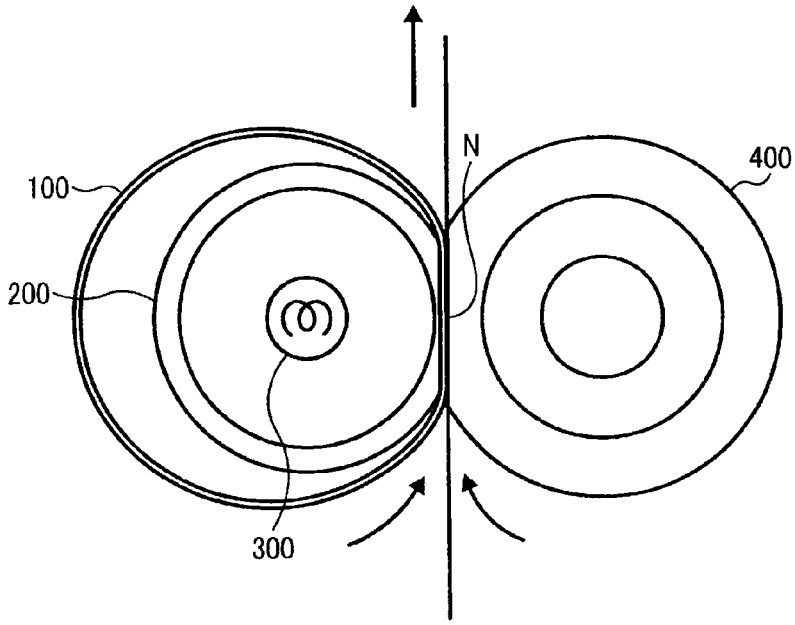
FIG. 1 RELATED ART
FIG. 1 is a schematic diagram of a conventional fixing device using a fixing belt.
Figure 2:
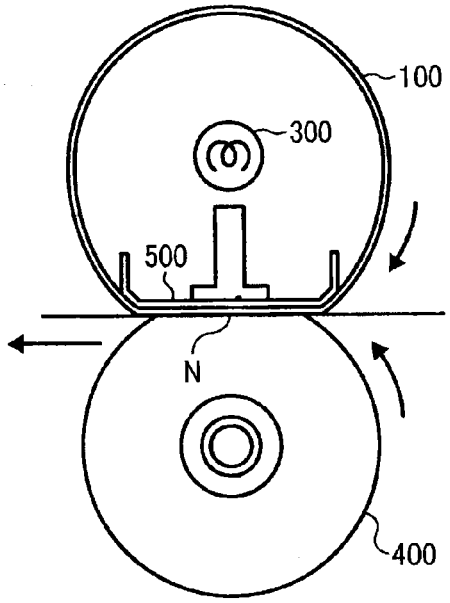
FIG. 2 RELATED ART
FIG. 2 is a schematic diagram of a conventional fixing device employing a direct heating method.
Figure 3:
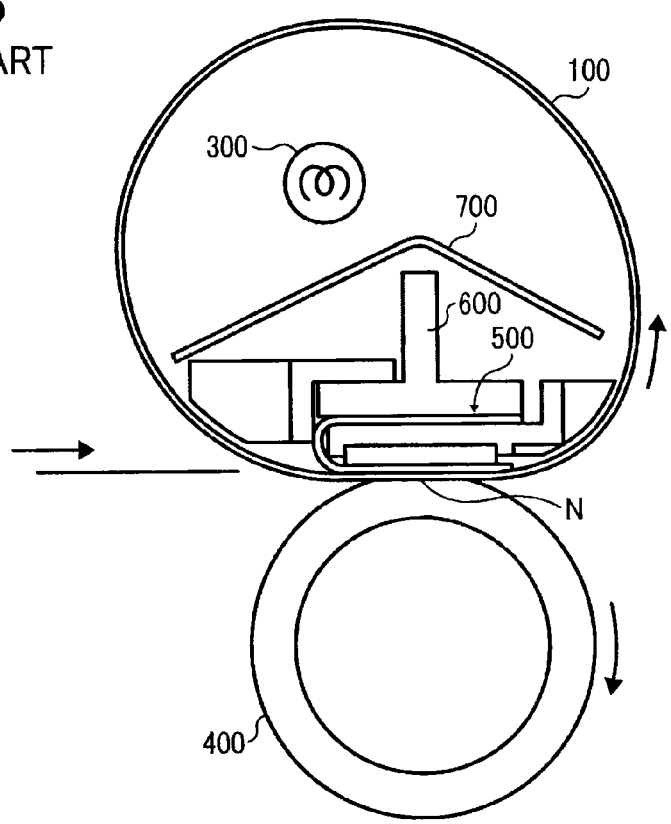
FIG. 3 RELATED ART
FIG. 3 is a schematic diagram of another conventional fixing device using a direct heating method.

Embodiments of the present invention are described below with reference to the accompanying drawings. In the drawings, identical reference characters are assigned to identical or similar members, and the redundant descriptions thereof are omitted.

Figure 5:
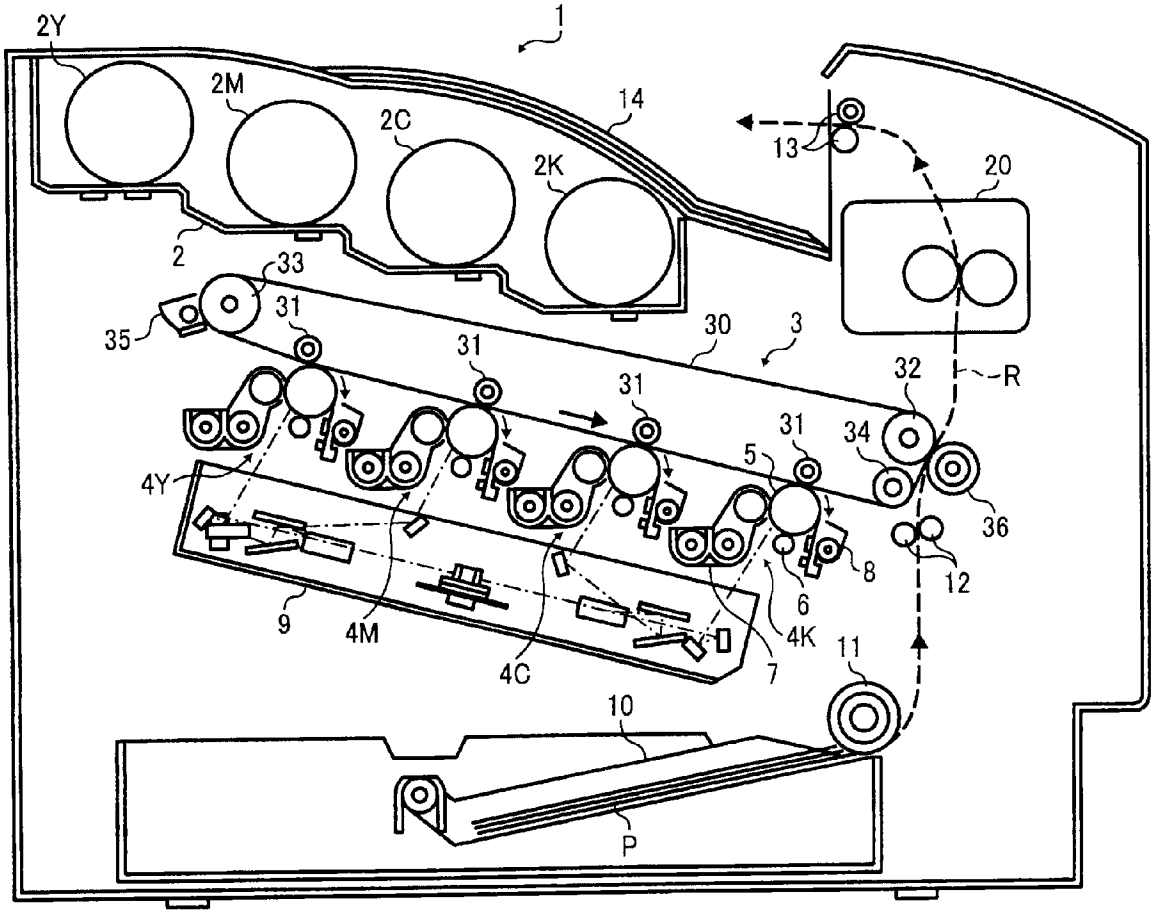
FIG. 5 is a schematic diagram of an embodiment of an image forming apparatus according to the present invention.

Referring to FIG. 5, an embodiment of the image forming apparatus according to the present invention is described. The image forming apparatus 1 shown in FIG. 5 is a color laser printer. In the center of the image forming apparatus 1, four image forming units, 4Y, 4M, 4C and 4K are provided. The respective image forming units, 4Y, 4M, 4C and 4K have the identical configuration excepting that they store the developer of different colors, yellow (Y), magenta (M), cyan (C) and black (K) that correspond to the separate color components of a color image.

More specifically, each image forming unit 4Y, 4M, 4C and 4K, includes a drum shaped photoreceptor 5 that is a latent image bearing member, a charging device 6 that charges the surface of the photoreceptor 5, a developing device 7 that supplies toner to the surface of the photoreceptor 5, and a cleaning device 8 that cleans the surface of the photoreceptor 5. In FIG. 5, reference characters are assigned only to the photoreceptor 5, the charging device 6, the developing device 7 and the cleaning device 8 provided in the image forming unit 4K, and are omitted in the other image forming units 4Y, 4M and 4C.

Underneath each image forming unit 4Y, 4M, 4C and 4K, an exposure device 9 that exposes the surface of the photoreceptor 5 is provided. The exposure device 9 includes a light source, a polygon mirror, a f-θ lens, and a reflection mirror, etc. so that the surface of each photoreceptor 5 is irradiated with a laser light beam based on image data.

Above each image forming unit 4Y, 4M, 4C and 4K, a transfer device 3 is provided. The transfer device 3 includes an intermediate transfer belt 30 that is a transfer body, four primary transfer rollers 31 that are the primary transfer means, a secondary transfer roller 36 that is the secondary transfer means, a secondary transfer backup roller 32, a cleaning backup roller 33, a tension roller 34, and a belt cleaning device 35.

The intermediate transfer belt 30 is an endless belt, extended and wound around a secondary transfer backup roller 32, a cleaning backup roller 33 and a tension roller 34. The intermediate transfer belt 30 rotates in the direction indicated by the arrow in the FIG. 5 when the secondary transfer backup roller 32 is driven to rotate.

Each of the four primary transfer rollers 31 sandwiches the intermediate transfer belt 30 with the photoreceptor 5 to form a respective primary transfer nip. Further, each primary transfer roller 31 is connected to a power supply, not shown, so that a predetermined direct voltage (DC) and/or an alternating voltage (AC) are applied to the respective primary transfer rollers 31.

The secondary transfer roller 36 sandwiches the intermediate transfer belt 30 with the secondary transfer backup roller 32 to form a secondary transfer nip. Further, similarly to the primary transfer rollers 31, the secondary transfer roller 36 is connected to a power supply, not shown, so that a predetermined direct voltage (DC) and/or an alternating voltage (AC) is applied to the secondary transfer roller 36.

The belt cleaning device 35 includes a cleaning brush and a cleaning blade disposed to contact the intermediate transfer belt 30. A waste toner transfer hose, not shown, extending from the belt cleaning device 35 is connected to an intake of a waste toner container, not shown.

At a top portion of the main body of the printer, a bottle container 2 is provided. In the bottle container 2, four toner bottles 2Y, 2M, 2C and 2K storing the toner for resupplying the toner are detachably provided. Supply routes, not shown, are provided between the respective toner bottles 2Y, 2M, 2C and 2K and the respective developing units 7. The toner is supplied to each developing unit 7 from the respective toner bottles 2Y, 2M, 2C and 2K via the supply routes.

Meanwhile, at the lower part of the main body of the printer, a paper feed tray 10 that stores papers P that are recording mediums, and a paper feeding roller 11 to feed the paper P from the paper feed tray 10 are provided. In this case, in addition to plain paper, the recording medium may be cardboard, a postcard, an envelope, thin paper, coated paper (for example, art paper, etc.), tracing paper, an OHP sheet and so on. Optionally, a manual paper feed mechanism may be also provided.

In the main body of the printer, a conveyance path R to output the paper P to the outside the apparatus passes through the secondary transfer nip from the paper feed tray 10. Along the conveyance path R, a pair of registration rollers 12 which serves as a conveyance means to convey the paper P to the secondary transfer nip is provided at the upstream side in the paper conveyance direction from the position of the secondary transfer roller 36.

Further, a fixing device 20 to fix the unfixed image transferred to the sheet P is provided at the downstream side in the paper conveying direction from the secondary transfer roller 36. A pair of paper output rollers 13 to output the paper to the outside of the apparatus is provided at the downstream side from the fixing device 20 in the paper conveyance direction along the conveyance path P. Further, a paper output tray 14 to stack the paper output to the outside of the apparatus is provided at the top of the printer.

The basic operation of an embodiment of the printer according to the present invention is described referring to FIG. 5.

When the image forming operation is started, each photoreceptor 5 of the image forming units 4Y, 4M, 4C and 4K is driven to rotate in the clockwise direction in FIG. 5, by a drive unit, not shown, and the surface of the respective photoreceptors 5 is charged uniformly at a predetermined polarity by a charging unit 6. A laser beam is radiated from the exposure unit 9 to irradiate the surface of the photoreceptors 5 so as to form an electrostatic latent image on the surface of the photoreceptors 5, respectively. At this time, the image information to be exposed at each photoreceptor 5 is the monochromatic image data decomposed into yellow, magenta, cyan and black from the desired full color image. The electrostatic latent image formed on the photoreceptor 5 in this manner is rendered visible as a toner image by supplying the toner to the electrostatic latent image from each developing device 7.

When the image forming operation is started, the secondary transfer backup roller 32 is driven to rotate counterclockwise in FIG. 5 so that the intermediate transfer belt 30 is rotated in the direction shown by the arrow in FIG. 5, and a charge which has the opposite polarity to the polarity of the toner and is controlled at a constant voltage or a constant current is applied to each primary transfer roller 31. With this process, a transfer electric field is formed at the primary transfer nip between the primary transfer roller 31 and the photoreceptor 5.

Then, when the toner image of each color on the photoreceptor 5 has reached the primary transfer nip with the rotation of each photoreceptor 5, the toner image on each photoreceptor 5 is transferred sequentially and superimposed on the intermediate transfer belt 30 by the transfer electric field formed in the primary transfer nip. Thus, a full color toner image is held on the surface of the intermediate transfer belt 30. Further, remaining toner on each photoreceptor 5 which was not transferred to the intermediate transfer belt 30 is removed by the cleaning unit 8. After that, the surface of each photoreceptor 5 is discharged by a neutralizing unit, not shown, so that the surface potential is initialized.

At the bottom of the image forming apparatus, a paper feeding roller 11 starts to be driven to rotate, and the paper P is fed to the conveyance path R from the paper feed tray 10. The paper P fed to the conveyance path R is sent to the secondary transfer nip between the secondary transfer roller 36 and the secondary transfer backup roller 32 at a timing controlled by the registration roller 12. At this moment, a transfer voltage having a polarity opposite to the polarity of the toner of the toner image on the intermediate transfer belt 30 is applied so that a transfer electric field is formed in the secondary transfer nip.

After that, while the intermediate transfer belt 30 is rotated, when the toner image on the intermediate transfer belt 30 reaches the second transfer nip, the toner image on the intermediate transfer belt 30 is transferred onto the paper P by the transfer electric field formed in the secondary transfer nip. Further, at this time, the residual toner on the intermediate transfer belt 30 which was not transferred to the paper P is removed by the belt cleaning unit 35, the removed toner is conveyed to the waste toner container to be collected.

Then, the paper P is conveyed to the fixing device 20, and, the toner image is fixed to the paper P. The paper P is output to the outside of the apparatus and stacked on the paper output tray 14.

The above description is of the image forming operation for forming a full color image on the paper. However, a monochromatic image may be formed by using one of the four image forming units 4Y, 4M, 4C and 4K, or two color or three-color images may be formed by using two or three image forming units.

Figure 6:
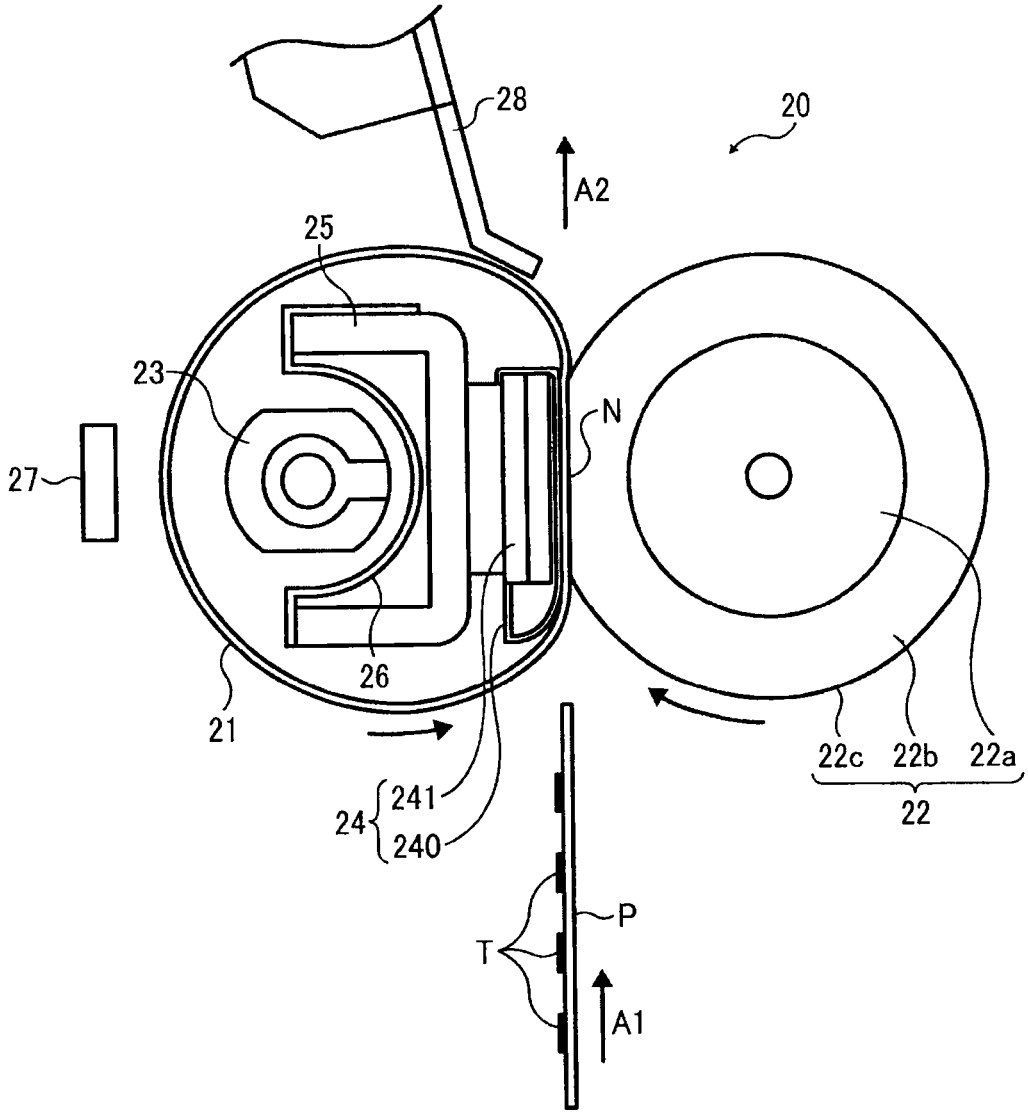
FIG. 6 is a schematic diagram of a fixing device mounted in the image forming apparatus.

Next, a configuration of the fixing device 20 is described based on FIG. 6.

As shown in FIG. 6, the fixing device 20 includes a fixing belt 21 that is a rotatable fixing rotating body, a pressure roller 22 which is a rotatable counter rotating body and is rotatably provided to face the fixing belt 21, a halogen heater 23 that is a heating source to heat the fixing belt 21 by radiant heat, a nip forming member 24 disposed inside the fixing belt 21, a stay 25 that is a support member to support the nip forming member 24, a reflective member 26 which reflects the light emitted from the halogen heater 23 to the fixing belt 21, a temperature sensor 27 that is a temperature detecting means to detect the temperature of the fixing belt 21, a separation member 28 to separate the paper from the fixing belt 21, a biasing means, not shown, to bias the pressure roller 22 to the fixing belt 21, and so on.

The fixing belt 21 is formed of a thin and flexible endless belt member. Alternatively, instead of a belt, a film may be used. More specifically, the fixing belt 21 includes a substrate material formed of a metallic material such as nickel or SUS etc., or a resin material such as polyimide (PI), etc. at the inner peripheral side, and a release layer formed of tetrafluoroetylene-perfluoroalkylvinylether copolymer (PFA), or polytetrafluoroethylene (PTFE), etc. at the outer peripheral side. Further, an elastic layer made of rubber material such as silicone rubber, foamed silicone rubber, or fluoro rubber may be interposed between the substrate material and the release layer.

The pressure roller 22 includes a metal core 22*a*, an elastic layer 22*b* formed of foamed silicone rubber, silicone rubber, fluorine rubber, etc. provided on a surface of the metal core 22*a*, and a release layer 22*c* formed of PFA, PTFE, etc. provided on the surface of the elastic layer 22*b*. The pressure roller 22 is pressed against the fixing belt 21 by a biasing means, not shown, to contact the nip forming member 24 through the fixing belt 21. At the point where the pressure roller 22 is pressed against the fixing belt 21, the elastic layer 22*b* of the pressure roller 22 is compressed so that a nip portion N having a predetermined width thereat is formed. Further, the pressure roller 22 is configured to be driven to rotate by a drive device such as a motor, not shown, provided in the main body of the printer. When the pressure roller 22 is driven to rotate, the driving force is transmitted to the fixing belt 21 at the nip portion N to rotate the fixing belt 21 in accordance with the rotation of the pressure roller 22.

Although in this embodiment, the pressure roller 22 is a solid roller, alternatively, it may be a hollow roller. In that case, the heat source such as a halogen heater may be disposed inside the pressure roller 22. When there is no elastic layer, the heat capacity decreases so that the fixing performance is improved. However, there is a possibility that tiny irregularities on the surface of the belt are transferred to the recording medium sheet and cause gloss unevenness in the solid image when unfixed toner is compressed and fixed. To prevent this problem, it is desirable to provide an elastic layer of a thickness of more than 100 μm because tiny irregularities can be absorbed by elastic deformation of the elastic layer by providing the elastic layer of that thickness. Accordingly, it is possible to avoid the occurrence of the gloss unevenness. The elastic layer 22*b* may be solid rubber. When the heat source is not provided inside the pressure roller 22, sponge rubber may be used. Sponge rubber is more preferable because the thermal insulation performance is increased so that the heat of the fixing belt 21 is hardly reduced. Further, the above-described structure is not limited to a configuration in which the fixing rotating body and the counter rotating body contact to each other firmly. Alternatively, a configuration in which the fixing rotating body touches the counter rotating body only slightly without applying any substantial pressure is also possible.

As for the halogen heater 23, both ends of the halogen heater 23 are fixed to the side plates, not shown, of the fixing device 20. It is configured that the output of the halogen heater 23 is controlled by a power supply unit provided in the main body of the printer to generate and output the heat. The output control is performed based on the detection result of the surface temperature of the fixing belt 21 detected by the temperature sensor 27. By this output control of the heater 23, the temperature of the fixing belt 21 (fixing temperature) can be set to a desired temperature. Further, as the heat source, it is possible to use an induction heater (IH), a resistance heating element and a carbon heater, etc. other than the halogen heater.

The nip forming member 24 includes a base pad 241 and a sliding sheet 240 (low-friction sheet) provided on the surface of the base pad 241. The base pad 241 extends continuously over the axial direction of the fixing belt 21 or the axial direction of the pressure roller 22 and determines the shape of the nip portion N by receiving the pressure of the pressure roller 22. Further, the base pad 241 is fixedly supported by a stay 25. This prevents the deflection in the nip forming member 24 from occurring under the pressure by the pressure roller 22 so that a uniform nip width can be obtained over the axial direction of the pressure roller 22. In order to prevent the deflection of the nip forming member 24 from occurring, it is desirable to form the stay 25 with a metal material having high mechanical strength, such as stainless steel or iron. Further, it is also desired to form the base pad 241 with a hard material to some extent to ensure the strength. As the material for the base pad 241, a resin such as liquid crystal polymer (LCP), etc., or a metal, or a ceramic may be used.

Further, the nip forming member 24 is formed of a heat resistant member able to withstand temperatures above 200° C. With this configuration, it is possible to avoid the deformation of the nip forming member 24 by the heat of a temperature in the toner fixing temperature range, and ensure a stable state of the nip portion N so as to keep the output image quality stable. The nip forming member 24 may be formed using common heat-resistant resins such as polyethersulfone (PES), poly phenylene sulfide resin (PPS), liquid crystal polymer (LCP), polyether nitrile (PEN), polyamide imide (PAI), polyetheretherketone (PEEK) and so on.

The sliding sheet 240 may be disposed at least on a surface of the base pad 241 which faces the fixing belt 21. With this configuration, when the fixing belt 21 is rotated, the fixing belt 21 slides over the low-friction sheet so that the driving torque generated in the fixing belt 21 is reduced so as to reduce the load generated by friction with the fixing belt 21. Alternatively, it is also possible to employ a configuration in which a sliding sheet is not provided.

The reflective member 26 is disposed between the stay 25 and the halogen heater 23. In this embodiment, the reflective member 26 is fixed to the stay 25. Aluminum or stainless steel and the like may be used as the material for the reflective member 26. Since the reflective member 26 is provided in this way, the light emitted from the halogen heater 23 to the stay 25 is reflected onto the fixing belt 21. Accordingly, it is possible to increase the amount of light to be radiated onto the fixing belt 21, thereby heating the fixing belt 21 efficiently. Further, it is possible to suppress the radiant heat being transmitted to the stay 25 and the like from the halogen heater 23 so as to also achieve energy saving.

In the fixing device 20 according to the present invention, the fixing belt 21 can be heated directly at portions other than the fixing nip portion N by the halogen heater 23 (direct heating method). In this embodiment, no member is provided between the halogen heater 23 and the left part of the fixing belt 21 in FIG. 6 so that the radiant heat can be applied directly to the fixing belt 21 from the halogen heater 23 in that part.

Further, in order to provide a fixing belt of a low heat capacity, the fixing belt 21 is formed to be thin and have a small diameter in its looped configuration. More specifically, the thicknesses of the base material, the elastic layer, and a release layer which form the fixing belt 21 ranges between 20 and 50 μm, between 100 and 300 μm, and between 10 and 50 μm, respectively, so as to set the total thickness of the fixing belt 21 at less than 1 mm. Further, the diameter of the fixing belt 21 is between 20 and 40 mm. In order to provide a fixing belt 21 of an even lower heat capacity, it is preferable that the overall thickness of the fixing belt 21 be equal to or less than 0.2 mm, more preferably less than or equal to 0.16 mm. Further, it is preferable that the diameter of the fixing belt 21 be equal to or less than 30 mm.

In this embodiment, the diameter of the pressure roller 22 is between 20 and 40 mm so that the diameter of the fixing belt 21 is configured to be equal to the diameter of the pressure roller 22. Alternatively, the diameter of the fixing belt 21 may be less than the diameter of the pressure roller 22. Such arrangement, in which the curvature of the fixing belt 21 in the nip portion N is smaller than the curvature of the pressure roller 22, facilitates separation of the recording medium from the nip portion N.

Figure 7A:
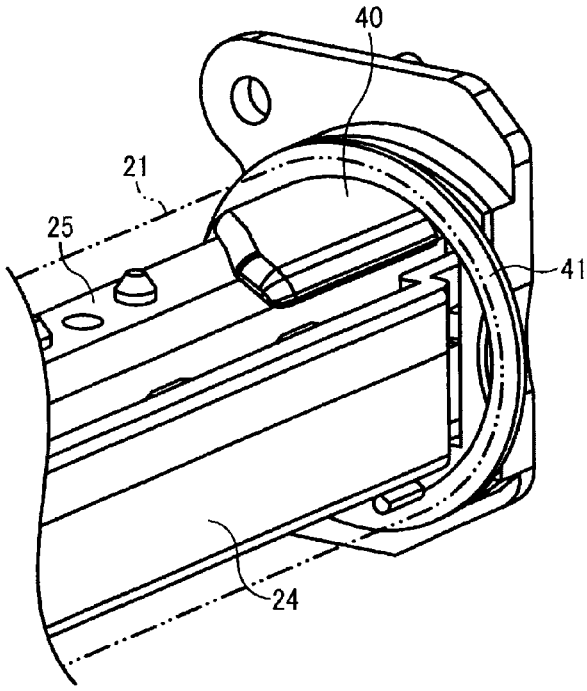
FIG. 7A is a perspective view of an end portion of the fixing belt.
Figure 7B:
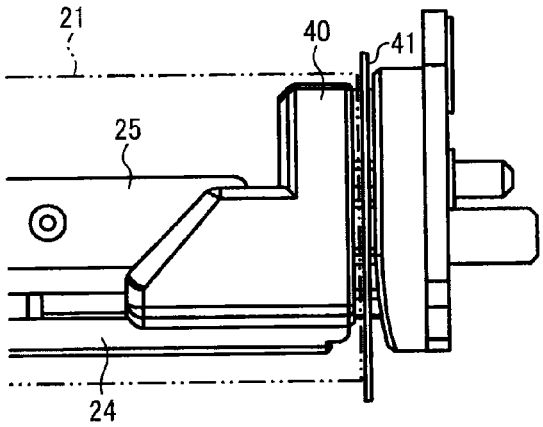
FIG. 7B is a plane view of the end portion of the fixing belt.
Figure 7C:
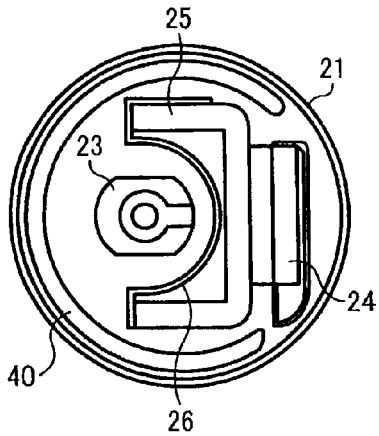
FIG. 7C is a side view of the end portion of the fixing belt viewing from a direction of the rotation axis of the fixing belt.

FIGS. 7A, 7B and 7C are views showing the configuration of the end portion of the fixing belt. FIG. 7A is a perspective view of the end portion of the fixing belt, FIG. 7B is a plane view of the end portion of the fixing belt, and FIG. 7C is a side view viewing from the axial direction of the fixing belt. In FIGS. 7A, 7B and 7C, only the configuration of the one end portion is shown, however, the other end portion has the similar configuration to the end portion shown. Accordingly, only the configuration of the one end portion is described below based on FIGS. 7A, 7B and 7C.

As shown in FIG. 7A and FIG. 7B, a belt holding member 40 is inserted into the end portion of the fixing belt 21 so that the end of the fixing belt 21 is held rotatably by the belt holding member 40. As shown in FIG. 7C, the belt holding member 40 is formed to have a C shape in cross-section with an opening at the position of the nip portion (position where the nip forming member 24 is provided). Further, the end portion of the stay 25 is fixed to the belt holding member 40 to position the stay 25 in place.

Further, as shown in FIG. 7A and FIG. 7B, a slip ring 41 that serves as a protection member to protect the end portion of the fixing belt 21 is provided between the end surface of the fixing belt 21 and the counter surface of the belt holding member 40 that faces the end surface of the fixing belt 21. Accordingly, even when a wrinkle is generated in the axial direction of the fixing belt 21, it is possible to prevent the end portion of the fixing belt 21 from contacting the counter surface of the belt holding member 40 directly and prevent the end portion from being damaged. Further, the slip ring 41 is fitted to the belt holding member 40 with a sufficient margin that the slip ring 41 can be rotated in accordance with movement of the fixing belt 21 when the end portion of the fixing belt 21 is in contact with the slip ring 41. Alternatively, the slip ring need not rotate, but can remain stationary. As the material of the slip ring 41, it is preferable to employ so-called super engineering plastics having excellent heat resistance, for example, PEEK, PPS, PAI, PTFE, and the like.

The drawings are not shown, however, at the two ends of the fixing belt 21 in the axial direction, a shielding member is disposed between the fixing belt 21 and the halogen heater 23 to shield the heat from the halogen heater 23. More specifically, the shielding member is disposed outside the area corresponding to the maximum paper width. By contrast, the reflective member 26 is disposed in the area corresponding to the maximum paper width. Therefore, particularly, it is possible to suppress excessive temperature rise in the area of the fixing belt over which the paper does not pass during continuous paper feed and prevent the fixing belt from being degraded or damaged by the heat of the fixing belt.

The basic operation of the fixing device according to the present embodiment is described referring to FIG. 6.

When the power switch of the main body of the printer is turned on, power is supplied to the halogen heater 23 and the pressure roller 22 is started to rotate in a clockwise direction in FIG. 6. Therefore, the fixing belt 21 is driven to rotate in accordance with the rotation of the pressure roller 22 in a counterclockwise direction in FIG. 6 by the frictional force between the fixing belt 21 and the pressure roller 22.

Then, the paper P carrying unfixed toner image T formed in the image forming process described above is guided by the guide plate, not shown, and conveyed in the direction shown by the arrow A1 in FIG. 6, and fed to the nip portion N between the fixing belt 21 and the pressure roller 22 which contact firmly to each other. Then, the toner image T on the surface of the paper P is fixed by heat of the fixing belt 21 heated by the halogen heater 23 and the pressure between the fixing belt 21 and the pressure roller 22.

The paper P having a fixed toner image T is conveyed in the direction shown by the arrow A2 in FIG. 6. At this moment, when the leading end of the paper P contacts the top end of the separation member 28, the paper P is separated from the fixing belt 21. Then, the separated paper P is output to the outside the apparatus, and is stacked in the paper output tray.

The configuration of the stay is described in more detail below.

Figure 8:
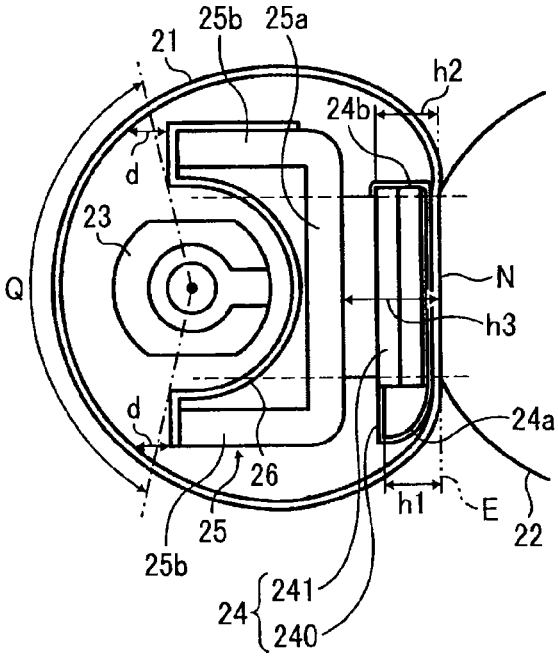
FIG. 8 is a schematic diagram illustrating a stay.

As shown in FIG. 8, the stay 25 includes a base portion 25*a* being in contact with the nip forming member 24 and extending in the paper conveyance direction (the vertical direction in FIG. 8), and a pair of arms 25*b* continuous with the base portion 25*a* and extending perpendicular to the base portion 25*a* from each end of the upstream side and the downstream side of the base portion 25*a* in the paper conveyance direction, in a pressing direction of the pressure roller 22 (towards the left side of FIG. 8). The pair of the arms 25*b* is disposed at a certain distance from each other in the paper conveyance direction, such that the respective arms 25*b* are disposed outside the two ends of the nip portion N in the paper conveyance direction (the position of the dotted line in the FIG. 8). In other words, the arm 25*b* of the upstream side (lower side in FIG. 8) of the pair of the arms 25*b* in the paper conveyance direction is disposed upstream from the upstream end portion of the nip portion N in the paper conveyance direction. The arm 25*b* of the downstream side (upper side in FIG. 8) is disposed downstream from the downstream end portion of the nip portion N in the paper conveyance direction.

As shown in FIG. 8, the halogen heater 23 is surrounded by the stay 25 configured as described above. More specifically, a part of the heat generating portion of the halogen heater 23 in the circumferential direction of the belt (consisting of the three sides that are the top, the bottom, and the right sides in FIG. 8) is surrounded by the base portion 25*a* and the pair of arms 25*b*. The other portion is not surrounded by the stay 25 so as to heat the fixing belt 21 directly thereat.

Further, in this embodiment, since the reflective member 26 is provided in the stay 25, a part of the heat generating portion of the halogen heater 23 in the circumferential direction of the belt is surrounded by the reflective member 26. More specifically, the reflective member is formed to have a concave shape, and the heat source is disposed inside the portion formed to have a concave shape so that a part of the heat generating portion of the halogen heater 23 is surrounded by the reflective member 26.

Thus, in the apparatus according to the present invention, since a part of the heat generating portion of the halogen heater 23 is surrounded by the stay 25 and the reflective member 26, the region in which the fixing belt 21 is directly heated is determined to be within a predetermined range. More specifically, in FIG. 8, when a region Q where the light is radiated directly onto the fixing belt 21 from the center of the heat generating portion of the halogen heater 23 (without going through the reflective member 26) is defined as the direct heating range, the direct heating region Q is set to be equal to or more than ⅓ and equal to or less than ½ of the circumferential length of the belt. When the direct heating area Q is less than ⅓ of the circumferential length of the belt, the region of the fixing belt 21 to be heated directly becomes narrow and the fixing belt 21 is expanded thermally and locally, accordingly, the deformation called kinking happens. By contrast, when the direct heating range Q exceeds ½ of the circumferential length of the belt, the direct heating range Q becomes too wide and the components which are not needed to be heated are heated other than the fixing belt 21, as a result, the heating efficiency is lowered.

Thus, by setting the direct heating region Q with the appropriate range as described above, it is possible to avoid kinking of the fixing belt 21 and heat the fixing belt 21 efficiently. Therefore, it is possible to improve energy efficiency, shorten the time to first print and provide a fixing device which can maintain a good fixing capability. In the embodiment, the direct heating region Q is set to ⅓ of the circumferential length of the belt.

Further, in the embodiment, the reflective member 26 is disposed between the halogen heater 23 and the stay 25 so as to cover the surface of the stay 25 at the halogen heater 23 side by the reflective member 26. With this configuration, it is possible to suppress the radiant heat being transmitted to the stay 25 from the halogen heater 23 so as to achieve energy saving and further shorten time to first print.

When the reflective member 26 is disposed close to the halogen heater 23, the ratio of the radiant heat reflected by the reflective member 26 which the halogen heater 23 itself receives increases. Therefore, when the reflective member 26 is disposed at a position closer to the stay 25 than the halogen heater 23, the heat to be applied to the fixing belt 21 is increased so as to improve the heating efficiency. Further, in the embodiment, the reflective member 26 is fixed to the stay 25 to determine the position of the reflective member 26. However, heat is transmitted from the reflective member 26 to the stay 25 at the contacting portion between them. Accordingly, it is desirable that the contacting portion be as small as possible.

Further, in this embodiment, the stay 25 is configured in the way as described above so that the mechanical strength of the stay 25 is improved. More specifically, the stay 25 includes a pair of arms 25*b* extending towards the pressing direction of the pressure roller 22 so that the stay 25 has a horizontally long cross sectional shape extending in the pressure direction of the pressure roller 22 to increase the section modulus, thereby improving the mechanical strength of the stay 25.

Figure 4:
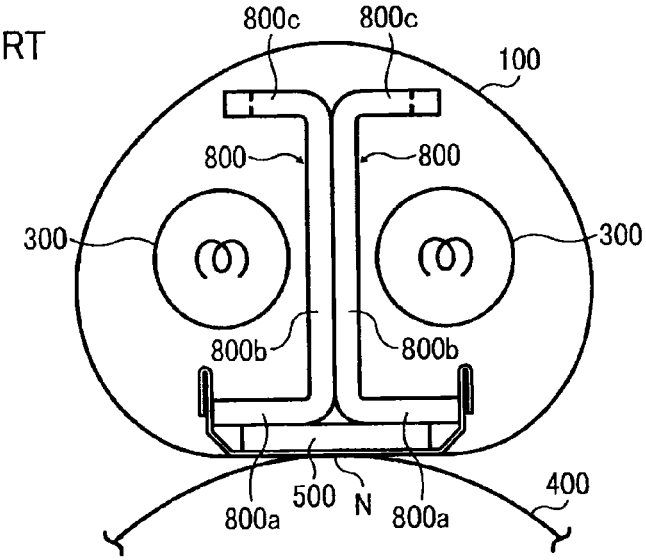
FIG. 4 RELATED ART
FIG. 4 is a schematic diagram of another conventional fixing device using a direct heating method.

In the conventional apparatus shown in FIG. 4, a reflective member 800 includes a support portion 800*b* extending in the pressure direction of the pressure roller 400, however, since this support portion 800*b* is disposed at the center of the nip portion N, it is not possible to support the load at the top portion of the pressure receiving portion 800*a*. Accordingly, if the stay 25 having a shape like the reflective member 800 shown in FIG. 4 is employed in the fixing device according to the present embodiment, deflection may occur at a portion which corresponds to the top portion of the pressure receiving portion 800*a*.

In this embodiment, however, a pair of arms 25*b* is provided at the two ends of the base portion 25*a*. Accordingly, the strength at the two ends of the base portion 25*a* can be improved so that it is possible to avoid the deflection formation at the two ends. More specifically, since a pair of arms 25*b* is provided at a distance from each other, the strength of the base portion 25*a* between the two arms 25*b* is improved. Further, since a pair of arms 25*b* is disposed at the outer position than the two ends of the nip forming portion N, the base portion 25*a* can be supported at a position outside the region in which the pressure of the pressing roller 22 is generated.

Thus, in this embodiment, the mechanical strength of the stay 25 is improved as a whole. Accordingly, it is possible to prevent the deflection of the nip forming member 24 due to the contact of the pressure roller 22 from occurring. Therefore, it is possible to form a nip width uniformly over the axial direction of the pressure roller 22, thereby obtaining a finer image.

Further, the arms 25*b* are disposed at least at a position corresponding to the two ends of the nip portion N, or at the outside thereof. More specifically, the arms 25*b* are disposed at the two end portions of a region of the fixing belt 21 which is subjected to the pressure from the pressure roller 22, or outside such range so that it is possible to improve the strength of the base portion 25*a* against the pressure. Alternatively, a configuration in which three or more arms 25*b* are provided is possible.

Further, in this embodiment, in order to improve the strength of the stay 25 further, the distal edge of the arm 25*b* is disposed as close as possible to the inner circumferential surface of the fixing belt 21. However, since the fixing belt 21 shakes to a greater or less extent while the fixing belt 21 is rotating, the fixing belt 21 may touch the distal edge of the arm 25*b* when the distal edge of the arm 25*b* is disposed too close to the inner circumferential surface of the fixing belt 21. Particularly, in the configuration according to the present invention which employs the thin fixing belt 21, the shaking amount of the fixing belt 21 is large, accordingly, it should be careful to set the position of the distal end of the arm 25*b*.

More specifically, in this embodiment, it is preferable to set a distance d between the distal end of the arm 25*b* shown in FIG. 8 and the inner circumferential surface of the fixing belt 21 in the contacting direction of the pressure roller 22 to at least 2.0 mm, and more preferably, more than 3.0 mm. By contrast, when the fixing belt 21 is thick to some extent and there is little shake, it is possible to set the distance d to 0.02 mm. Further, when the reflective member 26 is attached to the distal end of the arm 25*b* as in the present embodiment, it is necessary to set the distance d so that the reflective member 26 is not in contact with the fixing belt 21.

Thus, when the distal end of the arm 25*b* is disposed as close as possible to the inner circumferential surface of the fixing belt 21, it is possible to provide the arm 25*b* in a long area in the contacting direction of the pressure roller 22. With this configuration, even in the configuration using the fixing belt 21 having a small diameter, it is possible to improve the mechanical strength of the stay 25.

Further, in this embodiment, in order to provide a bigger stay, the nip formation member 24 is formed compactly. More specifically, the width of the base pad 241 in the paper conveyance direction is formed small compared to the width of the stay 25 in the paper conveying direction. Further, in FIG. 8, when the height of the end portion 24*a* of the base pad 241 at the upstream side in the paper conveyance direction for the nip portion N or the virtual extension line E thereof is h1 and the height of the end portion 24*b* of the base pad 241 at the downstream side in the paper conveyance direction for the nip portion N or the virtual extension line E thereof is h2, and the maximum height for the nip portion N other than the end portion 24*a* of the base pad 241 at the upstream side in the paper conveyance direction and the end portion 24*b* of the base pad 241 at the downstream side in the paper conveyance direction or the virtual extension line E thereof is h3, the fixing device is configured to satisfy the relation of $h1 \leq h3$, and $h2 \leq h3$.

With this configuration, it is possible to dispose each bending portion closer to the inner circumferential surface of the fixing belt 21 because the end portion 24*a* of the base pad 241 at the upstream side in the paper conveyance direction and the end portion 24*b* of the base pad 241 at the downstream side in the paper conveyance direction are not intervening between each bending portion of the upstream side of the stay 25 and the downstream side of the stay 25 in the paper conveyance direction and the fixing belt 21. Accordingly, it is possible to provide the stay 25 in the limited space in the fixing belt 21 with the largest possible size, thus, strengthening the stay 25.

Further, in the configuration according to the present invention in which no guide member other than the nip forming member 24 is provided between the fixing belt 21 and the stay 25 (the belt holding member 40 is provided at the end portion of the belt as a guide member), it is possible to dispose the stay 25 much closer to the fixing belt 21, thereby improving the strength of the stay further.

Figure 9:
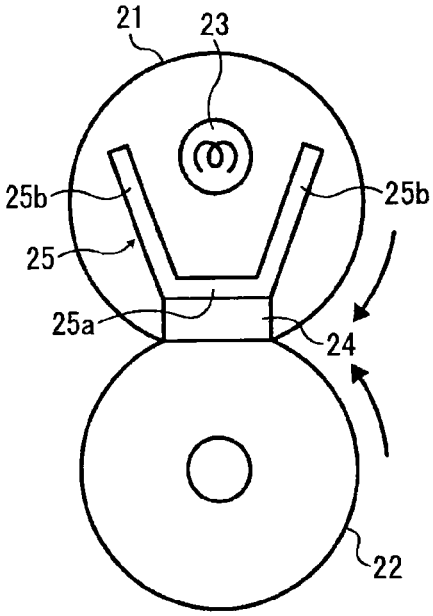
FIG. 9 is a modification example of the stay.

In the stay 25 according to the present embodiment, both arms 25*b* are formed substantially perpendicular to the base portion 25*a*. However, as shown in FIG. 9, both arms 25*b* may be provided in an outwardly inclined manner relative to the base portion 25*a* so that the tips of the arms 25*b* are farther apart than at the bases of the arms 25*b* where they attach to the base portion 25*a*. It is also possible to form the stay 25 in another shape.

Figure 10:
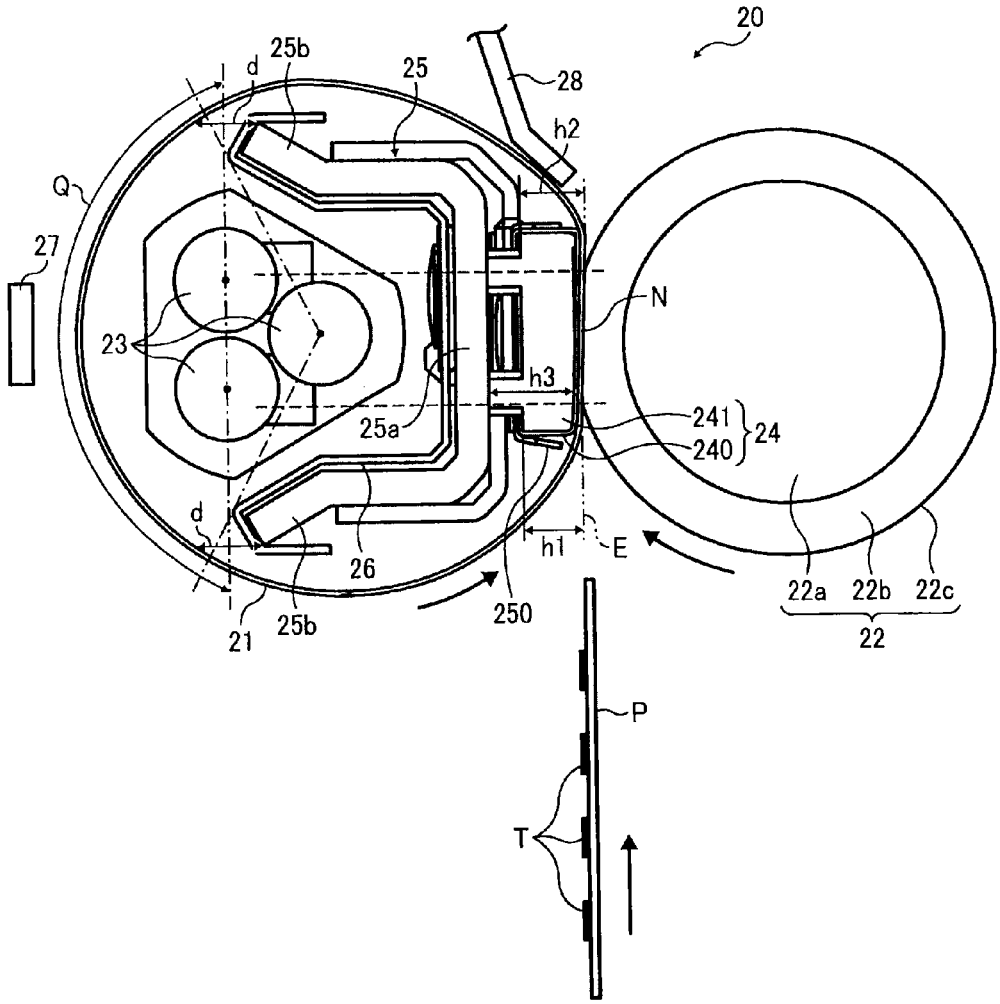
FIG. 10 is a schematic diagram of anther embodiment of the fixing device according to the present invention.

FIG. 10 is another embodiment of the fixing device according to the present invention. The fixing device 20 shown in FIG. 10 includes three halogen heaters 23 as the heating source. In this case, the heat generating region is varied at each halogen heater 23 so as to heat the fixing belt 21 in a variety of ranges to correspond to papers having different widths. Further, in this case, a metal plate 250 is provided so as to surround the nip forming member 24, and the nip forming member 24 is supported by the stay 25 through the metal plate 250. The remaining configuration is basically the same as the configuration of the embodiment shown in FIG. 6.

Accordingly, in this embodiment, similarly to the embodiment described above, a part of the heat generating portion of the halogen heater 23 is surrounded by the base portion 25*a* and the arms 25*b* so that the direct heating region Q of the fixing belt 21 can be set to the appropriate range in which the fixing belt 21 does not kink and the fixing belt 21 can be heated efficiently. Further, in FIG. 10, "h1", "h2" and "h3" are the heights in the base pad 241, respectively, in the same manner as described above. In this embodiment also, in order to provide the largest stay possible in the fixing belt 21, the fixing device is configured so as to satisfy the relation of $h2 \leq h3$, and $h1 \leq h3$.

As described above, according to the present invention, a part of the heat generating portion of the heat source is surrounded by the base portion and the arms included in a support member (stay), accordingly, the direct heating region of the fixing belt can be set to the appropriate range in which kinking is not generated and the fixing belt 21 can be heated efficiently. Therefore, it is possible to improve energy efficiency, shorten the time to first print and maintain a good fixing capability.

Particularly, in the configuration according to the present embodiment which employs the thin fixing belt 21, it tends to occur kinking easily, however, when the configuration according to the present invention is applied, it is possible to set the appropriate heat generating range in which kinking is not generated.

Further, in the embodiment according to the present invention, the reflective member 26 covers the surface of the halogen heater 23 at the stay 25 side. Accordingly, it is possible to suppress the radiant heat being transmitted to the stay 25 from the halogen heater 23, thus, improving the energy efficiency.

Further, in the embodiment described above, a pair of arms 25*b* is arranged at a distance from each other, and each arm 25*b* is disposed at the outer position than the two ends of the nip forming portion N so that the strength at the two ends of the base portion 25*a* can be improved, and it is possible to avoid the deflection formation at the two ends. Accordingly, it is possible to prevent the deflection of the nip forming member 24 from occurring due to the contact of the pressure roller 22. Consequently, it is possible to form the nip width uniformly over the axial direction of the pressure roller 22, thereby obtaining a fine image.

Embodiments according to the present invention have been described above. However, the disclosure of the present invention is not limited to the embodiments described above, and, numerous additional modifications and variations are possible in light of the above teachings. Further, the fixing device according to the present invention can be mounted to a variety of image forming apparatuses in addition to the color laser printer shown in FIG. 5, for example, a monochromatic image informing apparatus, printers, facsimile machine, or multifunction apparatus that prints, faxes, copies, and so on.

What is claimed is:

1. A fixing device that fixes an image on a recording medium, comprising:

a rotatable endless belt;

a nip forming member provided inside a loop formed by the belt;

a support that supports the nip forming member, the support including a base portion that contacts the nip forming member and two arms extending from the base portion in a direction away from the nip forming member;

a counter rotation body disposed outside the loop formed by the belt and configured to form a nip with the belt by being in contact with the nip forming member through the belt;

a heat source configured to heat a portion of the belt directly by a radiant heat without directly heating any portion of the nip; and a reflector provided between the heat source and the support to reflect the heat from the heat source, such that the reflector covers the support without surrounding an entirety of the support, and a concave portion of the reflector extending between the two arms of the support, wherein a first portion of the heat source is positioned to be directly between the two arms of the support and within the concave portion of the reflector, and a second portion of the heat source is positioned to be outside of the two arms of the support and the reflector, and wherein the two aims and the base portion are arranged so that the support has a cross sectional shape formed by the two arms and the base portion of the support that is longer in a direction perpendicular to a pressure direction of the counter rotation body than in the pressure direction.

2. The fixing device according to claim 1, wherein, as the two arms, the support includes three or more arms extending from the base portion in the direction away from the nip forming member.

3. The fixing device according to claim 1, wherein the reflector and the belt are separated apart by a distance of from 0.02 mm to 3 mm.

4. The fixing device according to claim 1, wherein the nip forming member includes a base pad having a width smaller than a width of the support in a recording medium conveyance direction.

5. The fixing device according to claim 1, wherein the two arms of the support are inclined relative to the base portion.

6. The fixing device according to claim 1, wherein the heat source is a halogen heater.

7. The fixing device according to claim 6, wherein the halogen heater is a plurality of halogen heaters.

8. The fixing device according to claim 1, further comprising a metal plate surrounding the nip forming member.

9. An image forming apparatus comprising the fixing device according to claim 1.

* * * * *